United States Patent [19]

Hajduk

[11] Patent Number: 4,925,018

[45] Date of Patent: May 15, 1990

[54] BULLET KEY BOB

[76] Inventor: Andrzej Hajduk, 307 E. Lake Shore Dr., Round Lake Park, Ill. 60073

[21] Appl. No.: 396,531

[22] Filed: Aug. 21, 1989

[51] Int. Cl.[5] ..... B65D 85/00; A45C 11/00

[52] U.S. Cl. ..... 206/38.1; 40/660; 206/37.8

[58] Field of Search ..... 206/37.1–37.8, 206/38.1; 40/660, 634; 70/456 R

[56] References Cited

U.S. PATENT DOCUMENTS

| | | | |
|---|---|---|---|
| D. 257,572 | 12/1980 | Wefler . | |
| 314,028 | 3/1885 | Jones | 40/660 |
| 314,028 | 3/1885 | Jones . | |
| 475,400 | 5/1892 | Houghton et al. | 40/660 |
| 481,448 | 8/1892 | Weeks | 40/660 |
| 692,173 | 1/1902 | Wilber | 40/660 |
| 1,099,869 | 6/1914 | Andersen | 40/660 |
| 1,210,927 | 1/1917 | Germain | 40/660 |
| 1,573,663 | 2/1926 | Warren | 40/660 |
| 1,644,150 | 10/1927 | Reynolds | 40/660 |
| 1,795,555 | 3/1931 | Greenwood . | |
| 2,232,333 | 2/1941 | McGehee | 206/38.1 |
| 3,283,717 | 11/1966 | Balch . | |
| 3,306,266 | 2/1967 | McCunney | 40/660 X |
| 4,248,071 | 2/1981 | Kussoy . | |
| 4,333,562 | 6/1982 | Todd | 40/660 |
| 4,460,174 | 7/1984 | Perry . | |
| 4,756,407 | 7/1988 | Larsen . | |

FOREIGN PATENT DOCUMENTS

| | | | |
|---|---|---|---|
| 026547 | 11/1906 | Austria | 40/660 |
| 1152638 | 8/1963 | Fed. Rep. of Germany | 40/660 |
| 115095 | of 1918 | United Kingdom | 40/660 |
| 2024002 | 1/1980 | United Kingdom | 70/456 R |

*Primary Examiner*—William Price

*Attorney, Agent, or Firm*—Wallenstein, Wagner & Hattis, Ltd.

[57] ABSTRACT

A key ring bob for attachment to a key ring or the like is disclosed. The key ring bob comprises a hollow body having an open and an other end. A cap is adapted to enclose the open end of the hollow body. A stem is axially attached to the cap at generally its center, and has a threaded portion along its length. The hollow body has at its other end a base portion with an threaded hole adapted to operatively engage with the threaded portion of the stem after insertion of the stem through the hollow body so that a portion of the stem protrudes through the threaded hole. The protruding end has a transverse hole through which a key ring or the like is inserted to connect the key ring bob to the key ring.

7 Claims, 1 Drawing Sheet

BULLET KEY BOB

BACKGROUND OF THE INVENTION

Key rings provide a simple, inexpensive, and convenient method of organizing and carrying keys. Attachments to key rings are also very popular, and their use is well-known. These attachments fulfill various ornamental and functional purposes, including storing change that would otherwise have to be carried loosely in one's pocket, and carrying important papers, such as emergency medical information or money.

Prior attempts to provide such attachments to key rings are many and varied. See, for example, U.S. Pat. Nos. 314,028, 3,306,266, and 4,333,562. These prior attempts, however, do not disclose the means for securely enclosing important papers within the apparatus as does the present invention.

SUMMARY OF THE INVENTION

According to the present invention, an improved key ring bob has been developed. In all embodiments of the present invention, the key ring bob comprises a hollow body having an open end and an other end. A cap is adapted to seal the open end of the hollow body. A stem is axially attached to the cap at generally the center thereof, and extends rearwardly therefrom. A base portion is adapted to enclose the other end of the hollow body.

In the preferred embodiment, the stem has a threaded portion along its length. The base portion has a threaded hole generally in its center to operatively engage with the threaded portion of the stem after insertion of the stem through the hollow body. The engagement of the threaded portion with the threaded hole acts to fasten the cap to the hollow body. The stem also preferably has an extension located at its free end. The extension protrudes through the threaded hole after the cap is securely fastened to the hollow body, and has a transverse hole through which a key ring is inserted, thereby connecting the key ring bob to the key ring.

In the preferred embodiment of the present invention, the key ring bob is manufactured from an empty, large caliber cartridge. The cartridge is preferably of a caliber of 0.44 magnum or larger. By using empty cartridges, manufacture of the present invention is made inexpensive and simple. The key ring bob of the present invention also provides a unique and improved means of enclosing important papers within the key ring bob. The present invention prevents accidental opening of the apparatus, and thus prevents loss of material enclosed therein. The key ring bob of the present invention is also attractive and ornamental.

Other advantages and aspects of the invention will become apparent upon making reference to the specification, claims, and drawings to follow.

DETAILED DESCRIPTION OF THE INVENTION

Figure 1:
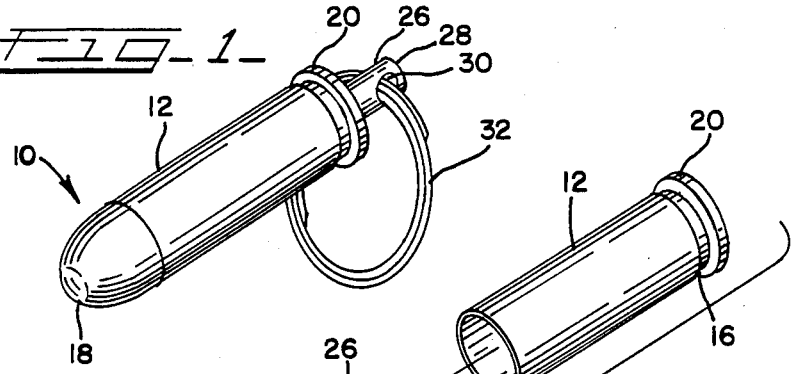
FIG. 1 is a perspective view of one embodiment of the present invention.
Figure 2:
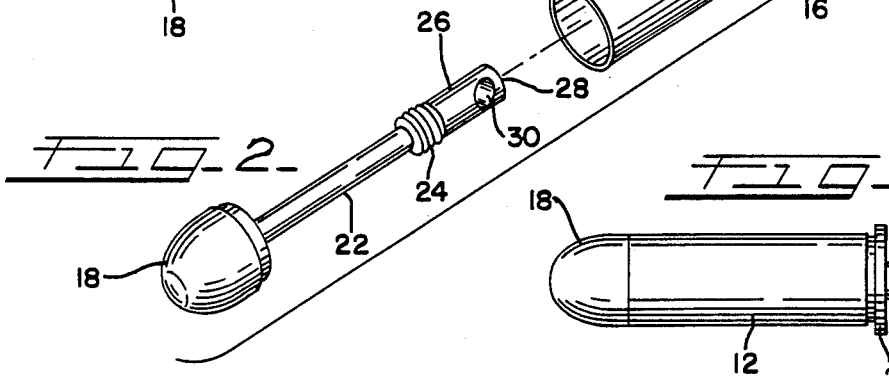
FIG. 2 is an exploded perspective view of one embodiment of the present invention.

While this invention is susceptible of embodiment in many different forms, there is shown in the drawings, and will herein be described in detail, a preferred embodiment of the invention with the understanding that the present disclosure is to be considered as an exemplification of the principles of the invention, and is not intended to limit the broad aspect of the invention to the embodiment illustrated.

Referring to the accompanying drawings, FIGS. 1 through 6 disclose a preferred embodiment of the present invention generally designated as 10. The key ring bob 10 preferably comprises a hollow, cylindrical body 12 having an open end 14 and an other end 16. The body 12 typically is of a length of approximately 1" to 4", and is of a diameter of about ½" to 1". A cap 18 is adapted to seal the open end 14 of the body 12. The cap 18 is, preferably, of a rounded conical shape. A base portion 20 encloses the other end 16 of the body 12.

A stem 22 is axially attached to the inside flat portion of the cap 18 and extends rearwardly therefrom. The stem 22 preferably is of a length of about ¼" to ½" greater than the length of the body 12, and of a diameter of about ⅛". The stem 22 preferably has a threaded portion 24 along its length to fasten the cap 18 to the hollow body 12. The stem 22 also preferably has an extension 26 located at its free end 28. The extension 26 is made up of the length of the stem 22 between the free end 28 and the threaded portion 24. The extension 26 preferably has a transverse hole 30 bored through it near the free end 28. A key ring 32 or the like is inserted through the hole 30 to connect the key ring bob 10 to the key ring 32 or the like.

The base portion 20 preferably has a threaded hole 34 located in generally the center thereof. The threaded hole 34 is adapted to operatively engage with the threaded portion 24 along the length of the stem 20. The extension 26 of the stem 22 preferably protrudes about ⅜" to ½" through the threaded hole 34 in the base portion 20.

In the preferred embodiment, the present invention is fashioned from an empty, large caliber cartridge of 0.44 magnum or larger. The bullet forms the cap 18. The case of the cartridge forms the hollow, cylindrical body 12 and the rim and head stamp form the base portion 26. The cartridge is modified as described above to form the key ring bob 10 of the present invention.

The key ring bob 10 of the present invention, preferably, may be used to carry paper money or other important papers (not shown) inside the hollow body 12. To carry such papers, they may be rolled up so as to fit within the hollow body 12 and then placed therein, or wrapped tightly around the stem 22 so that the paper is located entirely between the cap 18 and the threaded portion 24.

To enclose such papers in the key ring bob 10, the free end 28 of the stem 22 is then inserted into the open end 14 of the body 12. The stem 22 is inserted through the body 12 and also through the threaded hole 34 until the threaded portion 24 engages with the threaded hole 34 of the base portion 20. To fasten the cap 18 to the body 12 and thereby enclose the papers within the body 12, the cap 18 is rotated to cause the threaded portion 24 on the stem 22 and the threaded hole 34 of the base portion 20 to engage. Rotation of the cap 18 is continued until the cap 18 is securely fastened to the body 12 by the engagement of threaded portion 24 and the threaded hole 34.

Once the cap 18 is fastened to the body 12, the key ring bob 10 is attached to a key ring 32 or the like by placing the key ring 32 through the transverse hole 30 in the extension 26 of the stem 22.

To remove the papers from the body 12 of the key ring bob 10, the cap 18 is rotated in the opposite direction to that which fastened the cap 18 to the body 12. Rotation is continued until the threaded portion 24 of the stem 22 disengages from the threaded hole 34 of the base portion 20. The stem 22 is removed from the body 12 to expose the papers for easy removal from the body 12.

Figure 7:
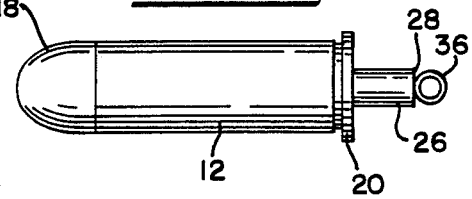
FIG. 7 is a side elevational view of another embodiment of the present invention; and, FIG. 8 is a sectional view of a further embodiment of the present invention.
Figure 3:
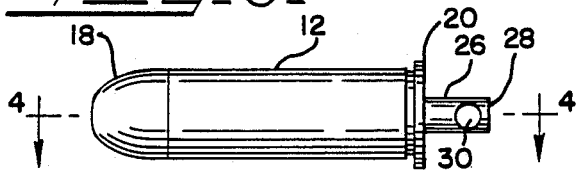
FIG. 3 is a side elevational view of one embodiment of, the present invention.

FIG. 7 discloses another embodiment of the key ring bob 10 wherein it is connected to a key ring 32 or the like through a loop 36. The loop 36 is attached to the free end 28 of the stem 22. A key ring 32 or the like is inserted through the loop 36 to connect the key ring bob 10 to the key ring 32.

Figure 8:
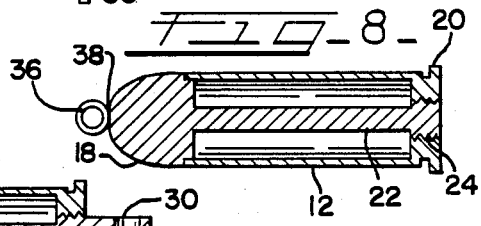
Figure 4:
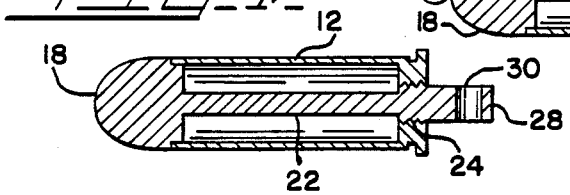
FIG. 4 is a sectional view taken along line 4—4 or, FIG. 3.
Figure 5:
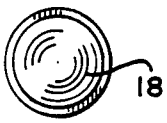
FIG. 5 is a front view of the present invention.
Figure 6:
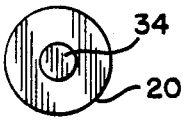
FIG. 6 is a rear view of the present invention.

FIG. 8 discloses a further embodiment the key ring bob 1O wherein the loop 36 is attached to the tip 38 of the cap 18. As in the previous embodiment, a key ring 32 or the like is inserted through the loop 36 to attach the key ring bob 10 to the key ring 32.

While the specific embodiments have been illustrated and described, numerous modifications come to mind without departing from the spirit of the invention, and the scope of protection is only limited by the scope of the accompanying Claims.

I claim:

1. A key ring bob comprising:

(a) a hollow body having an open end and an other end;

(b) a cap adapted to enclose said open end of said hollow body;

(c) a stem axially attached to said cap at generally the center thereof, said stem extending rearwardly from said cap and adapted to be inserted through said open end of said hollow body, said stem further having a threaded portion along its length;

(d) a base portion enclosing said other end of said hollow body, said base portion having a threaded hole to operatively engage said threaded portion of said stem, such that a portion of the free end of said stem protrudes through said threaded hole; and (e) means for connecting said key ring bob to a key ring or the like.

2. The key ring bob of claim 1 wherein said connecting means is located at the free end of said stem.

3. The key ring bob of claim 2 wherein said connecting means comprises a ring attached to the free end of said stem adapted to accommodate insertion of a key ring or the like therethrough.

4. The key ring bob of claim 2 wherein said connecting means comprises said protruding portion of said stem having a hole adapted to accommodate a key ring or the like.

5. The key ring bob of claim 1 wherein said cap comprises a bullet.

6. The key ring bob of claim 1 wherein said hollow body comprises a cartridge case.

7. The key ring bob of claim 1 wherein said base portion comprises the rim and head stamp of a cartridge.

* * * * *

UNITED STATES PATENT AND TRADEMARK OFFICE

CERTIFICATE OF CORRECTION

PATENT NO. : 4,925,018

DATED : May 15, 1990

INVENTOR(S) : Andrzej Hajduk

It is certified that error appears in the above-identified patent and that said Letters Patent is hereby corrected as shown below:

Column 1, Line 3, insert
--Technical Field of the Invention
The present invention relates to the field of attachments to key rings or the like.--

Column 1, Line 65, delete the comma "," after "of"

Column 1, Line 66, delete "or," and insert --of--

Signed and Sealed this

Twenty-fourth Day of September, 1991

*Attest:*

HARRY F. MANBECK, JR.

*Attesting Officer*

*Commissioner of Patents and Trademarks*